US012290853B2

(12) United States Patent
Yamashita et al.

(10) Patent No.: US 12,290,853 B2
(45) Date of Patent: May 6, 2025

(54) METHOD FOR MANUFACTURING HOT-FORGED MEMBER

(71) Applicant: PROTERIAL, LTD., Tokyo (JP)

(72) Inventors: Yoji Yamashita, Tokyo (JP); Chuya Aoki, Tokyo (JP); Shinichi Kobayashi, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 193 days.

(21) Appl. No.: 17/904,697

(22) PCT Filed: Mar. 12, 2021

(86) PCT No.: PCT/JP2021/010022

§ 371 (c)(1),
(2) Date: Aug. 19, 2022

(87) PCT Pub. No.: WO2021/182606

PCT Pub. Date: Sep. 16, 2021

(65) Prior Publication Data

US 2023/0068369 A1 Mar. 2, 2023

(30) Foreign Application Priority Data

Mar. 13, 2020 (JP) ..... 2020-044483

(51) Int. Cl.

| | |
|---|---|
| ***B21J 3/00*** | (2006.01) |
| ***B21J 1/02*** | (2006.01) |
| ***B21J 1/06*** | (2006.01) |
| ***B21J 5/00*** | (2006.01) |

(52) U.S. Cl.

CPC . *B21J 3/00* (2013.01); *B21J 1/02* (2013.01); *B21J 1/06* (2013.01); *B21J 5/00* (2013.01)

(58) Field of Classification Search

None

See application file for complete search history.

(56) References Cited

U.S. PATENT DOCUMENTS

| | | | |
|---|---|---|---|
| 4,504,527 | A | 3/1985 | Hara et al. |
| 10,427,211 | B2 | 10/2019 | Zhang et al. |
| 2014/0144199 | A1 | 5/2014 | Shigihara et al. |

(Continued)

FOREIGN PATENT DOCUMENTS

| | | | |
|---|---|---|---|
| CN | 1654876 | A | 8/2005 |
| CN | 101412066 | A | 4/2009 |

(Continued)

OTHER PUBLICATIONS

"English language translation of International Search Report", International Application No. PCT/JP2021/010022, Apr. 6, 2021, 3 pp.

(Continued)

*Primary Examiner* — Jared O Brown

(74) *Attorney, Agent, or Firm* — Myers Bigel, P.A.

(57) ABSTRACT

A method for manufacturing a hot-forged member includes heating an unheated material for hot forging in a furnace to a hot forging temperature; bonding a heat-resistant insulation material to at least a part of a surface of a material for forging removed from the furnace to obtain a material to be hot forged; and compressing a part or all of the material to be hot forged into a predetermined shape using any of a die, an anvil, and a tool.

3 Claims, 1 Drawing Sheet

(56) References Cited

U.S. PATENT DOCUMENTS

| | | | | |
|---|---|---|---|---|
| 2014/0271337 | A1* | 9/2014 | Banik | B21J 1/06 72/352 |
| 2014/0290321 | A1* | 10/2014 | Minisandram | B21C 23/32 72/46 |
| 2018/0100223 | A1* | 4/2018 | Kobayashi | B21J 5/00 |
| 2018/0281049 | A1* | 10/2018 | Ohtoyo | B21J 5/025 |
| 2023/0068369 | A1 | 3/2023 | Yamashita et al. | |

FOREIGN PATENT DOCUMENTS

| | | | | |
|---|---|---|---|---|
| CN | 103732771 | A | | 4/2014 |
| CN | 105328095 | A | * | 2/2016 |
| CN | 105478643 | A | * | 4/2016 |
| CN | 106040928 | A | | 10/2016 |
| CN | 106077379 | B | | 9/2019 |
| JP | S6040492 | B2 | | 9/1985 |
| JP | S6121287 | B2 | | 5/1986 |
| JP | H02224841 | A | | 9/1990 |
| JP | H05177289 | A | * | 7/1993 |
| JP | H1192169 | A | * | 4/1999 |
| JP | 2014508857 | A | | 4/2014 |
| JP | 2014210288 | A | | 11/2014 |
| JP | 6141499 | B2 | | 6/2017 |
| JP | 2017148817 | A | * | 8/2017 |
| JP | 6311973 | B2 | | 4/2018 |
| JP | 2018164925 | A | | 10/2018 |
| WO | 2012090892 | A1 | | 7/2012 |
| WO | 2012099710 | A2 | | 7/2012 |
| WO | 2021182606 | A1 | | 9/2021 |

OTHER PUBLICATIONS

"Communication with Supplementary European Search Report", EP Application No. 21767360.7, Jul. 12, 2023, 7 pp.

"English language translation of International Search Report", International Application No. PCT/JP2022/021761, Aug. 16, 2022, 2 pp.

"First Notice of Reasons for Refusal with English language translation", CN Application No. 202180020641.1, Dec. 27, 2024, 11 pp.

"Communication pursuant to Article 94(3) EPC", EP Application No. 21767360.7, Feb. 18, 2025, 5 pp.

* cited by examiner

METHOD FOR MANUFACTURING HOT-FORGED MEMBER

RELATED APPLICATIONS

This application is a 35 U.S.C. § 371 national stage application of PCT Application No. PCT/JP2021/010022, filed on Mar. 12, 2021, which claims priority from Japanese Patent Application No. 2020-044483, filed on Mar. 13, 2020, the contents of which are incorporated herein by reference in their entireties. The above-referenced PCT International Application was published in the Japanese language as International Publication No. WO 2021/182606 A1 on Sep. 16, 2021.

TECHNICAL FIELD

The present invention relates to a method for manufacturing a hot-forged member, and in particular, relates to a method for manufacturing a hot-forged member made of an alloy with poor workability.

BACKGROUND ART

When a material for hot forging heated to a hot forging temperature is hot forged, there is a problem of deterioration of hot workability due to a drop in temperature of the material for hot forging. Therefore, various proposals have been heretofore made to prevent the drop in temperature. For example, JP 2014-508857 A (Patent Document 1) discloses that a glass coating is applied to a material for hot forging to prevent thermal cracking. As a method of glass coating, a glass woven fabric and glass particles are arranged in sequence on the material for hot forging. This Patent Document 1 also discloses a conventional technique of enclosing the material for hot forging in a metal alloy can before hot working.

REFERENCE DOCUMENT LIST

Patent Document

Patent Document 1: JP 2014-508857 A

SUMMARY OF THE INVENTION

Problem to be Solved by the Invention

In the aforementioned Patent Document 1, as illustrated in the Examples, a glass woven fabric is wound around a material for hot forging at room temperature, an inorganic slurry is then applied onto the surface of the glass woven fabric, and the material is heated to a hot forging temperature in that state to form a glass coating layer. This method is certainly effective in suppressing a drop in temperature from the removal of the material for hot forging from a furnace to the start of hot forging. However, since the glass woven fabric itself has a heat insulating effect, it takes a long time to heat up to the forging temperature, and the method of wrapping the entire material in glass woven fabric, as illustrated in FIG. 3 of Patent Document 1, has a disadvantage of making it difficult to determine the temperature of the material for hot forging itself.

Typical alloys for which hot workability deteriorates as a result of a drop in temperature before the start of hot forging or during the hot forging of the material for hot forging heated to the hot forging temperature are Ni-base alloys and Ti alloys containing a γ' phase (gamma prime phase) in an amount of 20% by volume, are known as poor workability alloys. Since these poor workability alloys are excellent in high-temperature strength, they are used in aircraft parts and power generation equipment parts. In these applications, there is a demand for large-sized products to improve combustion efficiency and power generation efficiency, and the Ni-based alloys containing γ' in an amount of 20% by volume (hereinafter, referred to as high γ'-containing Ni-base alloys) are considered for use at a higher temperature. The hot forging temperature affects the occurrence of defects such as cracks and flaws, and in particular, some high γ'-containing Ni-base alloys have a limited temperature range in which hot forging is possible. Because it is important to achieve both hot workability and prevention of defects such as cracks, a method for efficient hot forging, while preventing cracks during hot forging, is required.

An object of the present invention is to provide a method for manufacturing a hot-forged member, the method enabling efficient hot forging while preventing defects such as cracks even when a poor workability alloy is used as a material for hot forging.

Means for Solving the Problem

The present invention has been devised in view of the problem described above.

The present invention is a method for manufacturing a hot-forged member, including: a heating step of heating an unheated material for hot forging in a furnace to a hot forging temperature; a heat-resistant insulation material bonding step of bonding a heat-resistant insulation material to at least a part of a surface of a material for forging removed from the furnace to obtain a material to be hot forged; and a hot forging step of compressing a part or all of the material to be hot forged into a predetermined shape using any of a die, an anvil, and a tool.

Also, in the method for manufacturing a hot-forged member according to the present invention, the hot forging step is open-die forging, and the heat-resistant insulation material is bonded to at least a part of a surface of a free deformation portion of a material for forging that is not in contact with any of the die, anvil, or tool in the open-die forging.

Preferably, the method for manufacturing a hot-forged member further includes a glass lubricant coating step of coating a glass lubricant on at least a portion of a surface of the unheated material to which the heat-resistant insulation material is to be bonded.

In the present invention, glass particles may be adhered to a surface of the heat-resistant insulation material to which the material for forging is to be bonded.

Preferably, in the method for manufacturing a hot-forged member, the heat-resistant insulation material is an inorganic fiber.

Effects of the Invention

According to the present invention, it is possible to perform efficient hot forging while preventing defects such as cracks even when a poor workability alloy is used as a material for hot forging.

MODE FOR CARRYING OUT THE INVENTION

Figure 1:
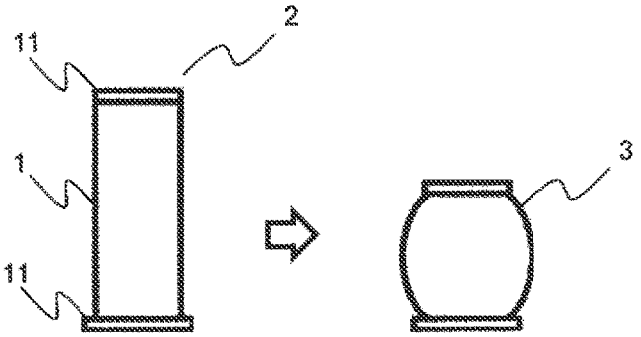
FIG. 1 is a schematic view illustrating an embodiment of a method for manufacturing a hot-forged member according to the present invention.

Hereinafter, each step of the present invention will be described. Note that the term "unheated material" as described below refers to a material before being charged into a furnace; the term "material for forging" refers to a material heated to a hot forging temperature in the furnace; the term "material to be hot forged" refers to a material having a heat-resistant insulation material bonded to a predetermined portion thereof that has been prepared for hot forging; and the term "hot-forged member" refers to a forming member that has been formed into a predetermined shape using a hot forging machine.

Heating Step

First, in the present invention, the unheated material to be hot forged is heated to a hot forging temperature in a furnace. Although the unheated material is not particularly limited to an ingot, a billet, a preform, a powder compact, or the like, the material most capable of demonstrating the effect of the present invention is, for example, an ingot and a billet that are formed into the desired shape by open-die forging. This unheated material is heated to a hot forging temperature in the furnace. The temperature of heating varies depending on properties of the unheated material and may be, for example, 950 to 1180° C. for a Ni-based alloy, and 1010 to 1180° C. for a high γ'-containing Ni-based alloy. It may also be 900 to 1180° C. for a Ti alloy. Note that in the present invention, a "heat-resistant insulation material bonding step" is applied after the heating step. In the heat-resistant insulation material bonding step, the heat-resistant insulation material is bonded to the material for forging removed from the furnace. It would be preferable if the drop in temperature of the material for forging were zero until this heat-resistant insulation material is bonded, but in reality, the temperature drops to some extent. Therefore, the hot forging temperature may be set at a temperature roughly 5 to 100° C. higher than a forging temperature at the start of hot forging (forging start temperature). As a result, even in a case in which the temperature of the material for forging would drop by more than 100° C. with respect to the forging start temperature if the heat-resistant insulation material is not bonded, the drop in temperature can be suppressed, thus maintaining a high temperature during hot forging.

In a case in which the unheated material is composed of Ni-based heat resistant superalloys, most of the alloys contain Cr in the range of 10 to 35% by mass. The oxygen concentration in the furnace is preferably controlled to be 10% or less for the purpose of suppressing reaction of Cr with oxygen in the furnace during the heating step. It is preferably 8% or less.

Note that the surface roughness of this unheated material should be rougher than that of a normal finish. When the heat-resistant insulation material is bonded to its surface in the next step, a small space is formed between the heat-resistant insulation material and the material for forging, and the air in the space is expected to function as a heat insulation layer. In addition, in a case in which a glass lubricant coating step described below is further included, the glass lubricant will easily remain on irregularities of the surface of the unheated material. Of course, a surface skin as cast or plastic worked is also acceptable, but in the case of alloys with poor workability, cracking or other defects may occur on the surface due to the influence of additive elements or the like. Thus, surface defects that may cause cracks at the time of hot forging of such alloys should be eliminated by machining. Even in cases in which no cracking or other defects are found, it is preferable to machine the surface of the unheated material to a roughness equal to or greater than that of the normal finish for a portion of the surface to which the heat-resistant insulation material is to be bonded in the next step.

Heat-Resistant Insulation Material Bonding Step

The unheated material is heated to the hot forging temperature, and the heat-resistant insulation material is bonded to at least a predetermined portion of a part of the surface of the material for forging removed from the furnace to form a material to be hot forged. The portion to be bonded may be a part of the surface or the entire surface. To decide where on this surface of the material for forging the heat-resistant insulation material should be bonded, one of the following two methods should be considered.

The first method is to preferentially prevent a drop in temperature in portions in which cracks are expected. If the time required to bond the heat-resistant insulation material to the forging material is long, the temperature of the material for forging may become low, which may deteriorate its hot forgeability. Therefore, it is preferable to bond the heat-resistant insulation material to its surface to the minimum extent necessary within a time that does not impair hot forgeability. For example, when the material to be hot forged is placed on the hot forging machine and then chilling of a lower die (lower anvil or lower tool) is concerned, for example, the heat-resistant insulation material may be bonded to a surface in contact with the lower die (lower anvil or lower tool), or if the material has a polygonal column shape, the heat-resistant insulation material may be bonded to an area including the edge portions. If the material has a cylindrical shape, the heat-resistant insulation material may be bonded to its side face. That is, the heat-resistant insulation material should be bonded including locations where defects such as cracks are likely to occur due to hot forging. This method is useful, particularly for a high γ'-containing Ni-based alloy, which is known as a poor workability alloy.

The second method is to bond the heat-resistant insulation material to at least a part of the surface of a free deformation portion of a material for forging. This method, for example, is mainly intended to reduce a drop in temperature of portions that are not in contact with an upper die (upper anvil or upper tool) or the lower die (lower anvil or lower tool) in a case in which hot forging is open-die forging because they are in a state of being cooled in the air. This method can contribute to reduction in flaws (cracks), for example, in alloys having a wide temperature range in which hot forging is possible, such as Alloy 718 and Waspaloy, since heating temperatures can be sustained.

The choice of the methods above should be made in consideration of the properties and shape of the material.

This bonding of the heat-resistant insulation material reduces the precipitation of fine γ' accompanying the drop in temperature of the material to be hot forged and can also promote the recrystallization of a surface layer of the material to be hot forged, thereby reducing the occurrence of defects such as cracks, for example, even in the case of the high γ'-containing Ni-based alloy, which is known as a poor workability alloy.

Note that to make the bonding of the heat-resistant insulation material easier and quicker in the heat-resistant insulation material bonding step, it is preferable to have glass lubricant present between the heat-resistant insulation material and a bonding surface of the material for forging to which the insulation material is bonded. The glass lubricant at this point is to function primarily as a "bonding agent". There are two methods for achieving this, each of which will be described below.

The first method is to perform a "glass lubricant coating step". The glass lubricant coating step further includes a step of coating a glass lubricant in advance on at least a portion of the surface of the unheated material to which the heat-resistant insulation material is to be bonded. Since the glass lubricant can act as a heat retaining agent after the heating, it is useful, particularly in a case in which a poor workability alloy is hot forged.

The second method is to adhere glass particles to the surface of the heat-resistant insulation material to be bonded to the material for forging and then bond the heat-resistant insulation material in a predetermined location. Since this method involves the bonding of the glass particles by softening them with the heat retained on the surface of the material for forging, it is useful to apply to hot forging of a Ni-based heat resistant superalloy or the like that requires high hot forging temperatures. Note that examples of methods of adhering glass particles to the heat-resistant insulation material include a method of sprinkling the glass particles on the surface of the heat-resistant insulation material to be bonded to the material for forging and a method of applying or spraying a glass lubricant containing glass particles (spray application). Of these methods, if the method of applying or spraying (spray application) the glass lubricant is selected, the heat-resistant insulation material to which the glass particles are adhered should be dried. The aforementioned method of spraying the glass lubricant is particularly preferred because it allows the glass particles to adhere uniformly to the surface of the heat-resistant insulation material to be bonded to the material for forging.

Note that, of course, the above two methods of the "glass lubricant coating step" and the "adhesion of glass particles to the surface of the heat-resistant insulation material to be bonded to the material for forging" may be employed in combination.

The heat-resistant insulation material is preferably an inorganic fiber. Note that the "inorganic fiber" as used herein includes a glass fiber, a ceramic fiber, or the like, and it is preferable to select a ceramic fiber, which has excellent heat insulation properties. Among ceramic fibers, KAOWOOL® (hereinafter, referred to as "Kaowool"), for example, is particularly preferred because it is easily available and is inexpensive. When the heat-resistant insulation material consists of inorganic fibers, even if the surface roughness of the material for forging is somewhat rough, it is easy to bond the fibers along the surface shape thereof. In addition, since the fibers are easily caught in irregularities of the surface of the material for forging and are also lightweight, it is also easy to bond the heat-resistant insulation material to the side faces of the material for forging, for example.

Furthermore, when Kaowool is bonded to at least a part of the surface of the material for forging removed from the furnace, as in the present invention, the Kaowool is maintained as it is at the early stage of hot forging, and the drop in temperature of the material to be hot forged can also be suppressed during hot forging. When Kaowool is arranged before being charged into the furnace, as in a conventional example, it becomes easily crushed at the time of transfer for hot forging, although this depends on the relationship between the temperature and time.

Hot Forging Step

The aforementioned material to be hot forged is used here. A part or all of the material to be hot forged is compressed into a predetermined shape using any of a die, an anvil, and a tool. A forging machine to be used is preferably a large hot forging machine with a forging load of several thousand tons or more capable of forming even poor workability alloys into predetermined shape.

In the present invention, the hot forging step is preferably open-die forging. When open-die forging is performed, the material to be hot forged is heavy, has a large area to dissipate heat into the air, and has a large working amount. Therefore, the heat-resistant insulation material is bonded to the material, resulting in a significant effect in suppressing the drop in temperature of the material to be hot forged. In this case, as mentioned above, if a general Ni-based alloy having a somewhat wide temperature range in which hot forging is possible, such as Alloy 718 and Waspaloy, is to be hot forged, then it is preferable to bond the heat-resistant insulation material to at least a part of a surface of a free deformation portion of a material for forging that is not in contact with any of the die, anvil, or tool in the open-die forging.

EXAMPLES

The present invention will be described in detail in Examples. Note that measurement temperatures of Inventive Examples shown in the following Examples were measured mainly in portions to which heat-resistant insulation materials were not bonded and portions in which a part of the material has fallen off during hot forging or after the end of hot forging.

Example 1

In addition to Alloy 718 (18.5% by mass of Cr) and Waspaloy (19.5% by mass of Cr), a high γ'-containing Ni-based alloy containing approximately 49.5% by volume of the γ' phase with 13.5% by mass of Cr, 25.0% by mass of Co, 2.8% by mass of Mo, 1.2% by mass of W, 6.2% by mass of Ti, 2.3% by mass of Al, 0.015% by mass of C, 0.015% by mass of B, 0.03% by mass of Zr, and the balance being Ni and inevitable impurities (hereinafter referred to as Alloy A) was prepared as an unheated material. The unheated materials were all ingots machined to a predetermined size, and each of the surfaces had a surface roughness equivalent to rough finishing. Note that to perform upset forging by hot open-die forging, the unheated materials having an L/D of 3 or less were used.

Prior to the heating step, as a glass lubricant coating step, the unheated materials were coated with a glass lubricant at a thickness of approximately 50 to 200 μm on end faces on opposite sides thereof (surfaces in contact with an anvil or a tool) at the point of the temperature of the material below 200° C. (glass lubricant coating step). This unheated material was heated to a predetermined hot forging temperature in a furnace (heating step). The oxygen concentration at such a point was controlled to be 2 to 8%. The temperature of heating (hot forging temperature) was 1100° C. for Alloy A and Alloy 718, and 1150° C. for Waspaloy, and the holding time was 2 to 9 hours. The time required to raise the temperature to the hot forging temperature was approximately 8 hours, which indicates that the temperature could rise to the predetermined one at least 10 hours sooner than in a conventional example in which the entire surface was wrapped in the heat-resistant insulation material.

Next, a heat-resistant insulation material 11 was bonded to surfaces of the end faces on opposite sides of a material for forging 1 removed from the furnace with a manipulator to form a material to be hot forged 2 (heat-resistant insulation material bonding step). The heat-resistant insulation material was Kaowool (inorganic fiber), which was bonded to the surface in contact with an anvil or a tool, as illustrated in FIG. 1, to suppress a drop in temperature of the material to be hot forged and the chilling caused by contact with the anvil or tool. Note that the previous coating of the glass lubricant allowed the Kaowool and the material for forging to bond together in a short time without any problem, so it was judged that a drop in temperature of about 5 to 10° C. compared to the normal drop in temperature before placement would not be a problem in hot forging.

The material to be hot forged was used to perform upset forging by hot open-die forging. After the material to be hot forged was placed on a lower anvil of a hot forging machine used and a tool for upset forging was placed on an upper-end face of a die for hot forging, open-die forging, which involves pressing by using a hot forging machine with a pressurization capacity of 4000 tons, was performed to make a preform (hot-forged member 3) for use in the next step of hot forging (hot forging step). Except for portions in which the lower anvil and the tool for upset forging were in contact with the material to be hot forged, the rest was a free deformation area. The forging start temperature was approximately 1000° C., and the forging temperature during hot forging was approximately 950 to 980° C. As described above, the Kaowool suppressed the chilling in the portions in contact with the lower anvil and the tool for upset forging on the side of the upper-end face, so surface defects such as wrinkle flaws (cracks) were hardly generated at the edges of the hot-forged member.

Example 2

A change of temperature during hot forging and the occurrence of flaws (cracks) in hot-forged members were compared for Waspaloy to which a heat-resistant insulation material was bonded (Inventive Example 1) and Waspaloy to which no heat-resistant insulation material was bonded (Comparative Example 1).

Materials for forging used were all ingots machined to a predetermined size, and each of the surfaces had a surface roughness equivalent to rough finishing. Note that upset forging by hot open-die forging was performed using the unheated materials having an L/D of 1.5 or less.

Prior to the heating step, as a glass lubricant coating step, the unheated material of Inventive Example 1 was coated with a glass lubricant at a thickness of approximately 50 to 200 μm on its end faces on opposite sides (surfaces in contact with an anvil or a tool) and a portion of its outer peripheral face to which the heat-resistant insulation material was bonded (glass lubricant coating step). This unheated material was heated to a predetermined hot forging temperature in a furnace (heating step). The oxygen concentration at such a point was controlled to be 2 to 8%. The temperature of heating (hot forging temperature) was 1150° C., and the holding time was 2 to 4 hours. The time required to raise the temperature to the forging temperature was approximately 8 hours.

Figure 2:
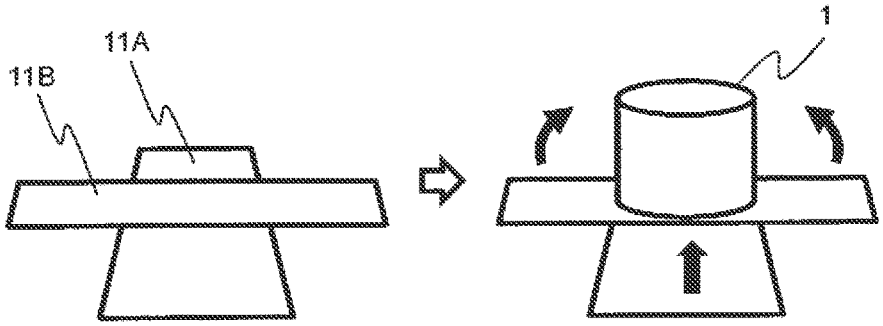
FIG. 2 is a schematic view illustrating an example of a method for making a material to be hot forged of the present invention.

Next, as illustrated in FIG. 2, two sheets of Kaowool (inorganic fiber) of different lengths (long 11A and short 11B) were stacked crosswise as heat-resistant insulation materials 11, a material for forging 1 of Inventive Example 2 removed from the furnace with a manipulator was placed on the stacked portion, and the heat-resistant insulation material was bonded to surfaces of both end faces on opposite sides and outer peripheral face of the material for forging while the inorganic heat insulation materials were folded in the direction of black arrows. The heat-resistant insulation material 11B was short in length and had a length close to the total height of the material for forging, whereas the longer heat-resistant insulation material 11A was stacked on a portion of the upper-end face of the material for forging and wrapped around almost the entire surface of the material for forging to form a material to be hot forged (heat-resistant insulation material bonding step). This suppressed a drop in temperature of the material to be hot forged, chilling caused by contact with the anvil or tool, and chilling caused by contact with a holding part of the manipulator. Note that in addition to the previous coating of the glass lubricant, adhesion of glass particles to the surface of Kaowool bonded to the material for forging allowed the Kaowool and the material for forging to bond together in a short time without any problem, so it was judged that a drop in temperature of about 5 to 10° C. compared to the temperature that normally dropped before placement would not be a problem in hot forging. Note that the material for forging in Comparative Example 1 was not coated with the heat-resistant insulation material.

The hot open-die forging was performed using the material to be hot forged. After the material to be hot forged was placed on a lower anvil of a hot forging machine used and a tool for upset forging was placed on an upper-end face of a die for hot forging, open-die forging, which involves pressing by using a hot forging machine with a pressurization capacity of 10000 tons, was performed to make a preform (hot-forged member) for use in the next step of hot forging (hot forging step). Except for portions at which the lower anvil and the tool for upset forging were in contact with the material to be hot forged, the rest was a free deformation area. The forging start temperature was approximately 1050° C., and the forging temperature during hot forging was approximately 1000° C.

When the temperature of the material to be hot forged immediately after upset forging was measured with a radiation thermometer, it was approximately 1090 to 1120° C. in Inventive Example 1, and 950 to 990° C. in Comparative Example 1. The temperature during hot forging could be maintained about 100° C. or higher in the case of Inventive Example 1. When the state of cracks in the hot-forged member made was checked, almost no cracks were visually observed in the hot-forged member of Inventive Example 1, whereas the hot-forged member of Comparative Example 1 had enough cracks to be visually observed on its end faces on opposite sides in contact with the anvil or tool and on side faces of the material for forging held by the manipulator.

Example 3

A change of temperature during swaging and the occurrence of flaws (cracks) in hot-forged members were compared for Waspaloy to which a heat-resistant insulation material was bonded (Inventive Example 2) and Waspaloy to which no heat-resistant insulation material was bonded (Comparative Example 2).

Unheated materials used were materials machined to a predetermined size after upset forging, and each of the surfaces had a surface roughness equivalent to rough finishing.

Prior to the heating step, as a glass lubricant coating step, the unheated material of Inventive Example 2 was coated with a glass lubricant at a thickness of approximately 50 to 200 μm on its end faces on opposite sides and a portion to which the heat-resistant insulation material was bonded (glass lubricant coating step). This unheated material was heated to a predetermined hot forging temperature in a furnace (heating step). The oxygen concentration at such a point was controlled to be 2 to 8%. The temperature of heating was 1150° C., and the holding time was 2 to 4 hours. The time required to raise the temperature to the forging temperature was approximately 8 hours.

Figure 3:
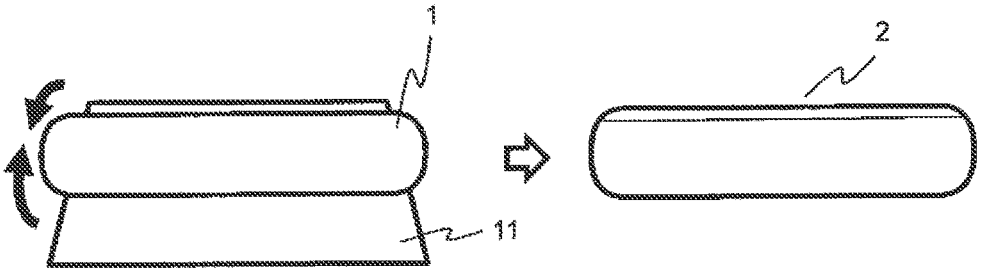
FIG. 3 is a schematic view illustrating an example of a method for making a material to be hot forged of the present invention.

Next, as illustrated in FIG. 3, a heat-resistant insulation material 11 was prepared, a material for forging 1 of Inventive Example 2 removed from the furnace with a manipulator was placed on the heat-resistant insulation material 11, and the heat-resistant insulation material was bonded to the surface of the outer peripheral face, whereas the heat-resistant insulation materials were bent in the direction of black arrows to form a material to be hot forged (heat-resistant insulation material bonding step). The heat-resistant insulation material was Kaowool (inorganic fiber), which was bonded to the outer peripheral face (free deformation portion of the material for forging) as illustrated in FIG. 3 to suppress a drop in temperature of the material to be hot forged and the chilling caused by contact with the holding part of the manipulator. Note that in addition to the previous coating of the glass lubricant, adhesion of glass particles to the face of Kaowool bonded to the material for forging allowed the Kaowool and the material for forging to bond together in a short time without any problem, so it was judged that a drop in temperature of about 5 to 10° C. compared to the normal temperature drop before placement would not be a problem in hot forging. Note that the material for forging in Comparative Example 2 was not coated with the heat-resistant insulation material.

The hot swaging was performed using the material to be hot forged. The side faces of the material to be hot forged were sandwiched between the lower and upper anvils of the hot forging machine, and swaging forging, which involves pressing by using a hot forging machine with a pressurization capacity of 4000 tons, was performed to make a preform (hot-forged member) for use in the next step of hot forging (hot forging step). The forging start temperature was approximately 1050° C. at an uncoated site, and the forged material temperature was approximately 1080 to 1020° C. at a location at which the coating had fallen off during hot forging.

When the temperature of the material to be hot forged immediately after hot forging was measured with a radiation thermometer, it was 950 to 980° C. in Inventive Example 2, and 900 to 950° C. in Comparative Example 2. The temperature during hot forging could be maintained about 50 to 80° C. or higher in the case of Inventive Example 2. When the state of cracks in the hot-forged member made was checked, almost no cracks were visually observed in the hot-forged member of Inventive Example 2, whereas the hot-forged member of Comparative Example 2 had enough cracks to be visually observed throughout the material.

According to the method for manufacturing a hot-forged member of the present invention described, it is obviously possible to perform efficient hot forging while preventing defects such as cracks even when a poor workability alloy is used as a material to be hot forged.

1: Material for forging
2: Material to be hot forged
3: Hot-forged member
11: Heat-resistant insulation material

The invention claimed is:

1. A method for manufacturing a hot-forged member, comprising:

heating an unheated material for hot forging in a furnace to a hot forging temperature to obtain a material for forging;

bonding a heat-resistant insulation material to at least a part of a surface of the material for forging to obtain a material to be hot forged, wherein the heat-resistant insulation material is a glass fiber or a ceramic fiber, and wherein glass particles are adhered to a surface of the heat-resistant insulation material to which the material for forging is to be bonded, by sprinkling the glass particles on the surface of the heat-resistant insulation material, or by applying or spraying a glass lubricant containing the glass particles on the surface of the heat-resistant insulation material and then drying the heat-resistant insulation material to which the glass particles are adhered; and hot forging a part or an entirety of the material to be hot forged without reheating it into a predetermined shape using any of a die, an anvil, and a tool, wherein the unheated material is composed of a Ni-based heat-resistant superalloy which contains Cr in a range of 10 to 35% by mass, and an oxygen concentration in the furnace is controlled to be 10% or less during the heating step.

2. The method for manufacturing a hot-forged member according to claim 1, wherein the hot forging step is open-die forging, and the heat-resistant insulation material is bonded to at least a part of a surface of a free deformation portion of the material for forging that is not in contact with any of the die, anvil, or tool in the open-die forging.

3. The method for manufacturing a hot-forged member according to claim 1, further comprising coating a glass lubricant on at least a portion of a surface of the unheated material to which the heat-resistant insulation material is to be bonded.

* * * * *